US005829405A

United States Patent [19]

Gödel

[11] Patent Number: 5,829,405

[45] Date of Patent: Nov. 3, 1998

[54] ENGINE CYLINDER LINER AND METHOD OF MAKING THE SAME

[75] Inventor: Peter Gödel, Freienried, Germany

[73] Assignee: AE Goetze GmbH, Burscheid, Germany

[21] Appl. No.: 802,427

[22] Filed: Feb. 18, 1997

[30] Foreign Application Priority Data

Feb. 17, 1996 [DE] Germany ..... 196 05 946.1

[51] Int. Cl.[6] ..... F02F 1/18

[52] U.S. Cl. ..... 123/193.2; 29/888.061

[58] Field of Search ..... 123/193.2; 29/888.061

[56] References Cited

U.S. PATENT DOCUMENTS

| | | | |
|---|---|---|---|
| 4,495,907 | 1/1985 | Kamo . | |
| 4,921,734 | 5/1990 | Thorpe et al. | 123/193.2 |
| 5,080,056 | 1/1992 | Kramer et al. | 29/888.061 |
| 5,358,753 | 10/1994 | Rao et al. | 29/888.061 |
| 5,363,821 | 11/1994 | Rao et al. | 123/193.2 |
| 5,598,818 | 2/1997 | Domanchuk . | |

FOREIGN PATENT DOCUMENTS

| | | |
|---|---|---|
| 0 716 156 | 6/1996 | European Pat. Off. . |
| 0 725 158 | 8/1996 | European Pat. Off. . |
| 0 732 493 | 9/1996 | European Pat. Off. . |
| 1282243 | 7/1969 | Germany . |
| 2344899 | 2/1974 | Germany . |
| 24 55 529 | 6/1975 | Germany . |
| 25 45 242 | 4/1977 | Germany . |
| 43 28 921 | 4/1994 | Germany . |
| 95/21994 | 8/1995 | WIPO . |

*Primary Examiner*—Marguerite McMahon
*Attorney, Agent, or Firm*—Spencer & Frank

[57] ABSTRACT

A method of making a cylinder liner for an internal-combustion engine includes the steps of applying a liner material to an outer cylindrical surface of a mandrel by thermal spraying for forming a coherent cylindrical sleeve on the mandrel; and removing the cylindrical sleeve from the mandrel. The cylindrical sleeve constitutes the cylinder liner.

12 Claims, 1 Drawing Sheet

ENGINE CYLINDER LINER AND METHOD OF MAKING THE SAME

REFERENCE TO RELATED APPLICATION

This application claims the priority of German Application No. 196 05 946.1 filed Feb. 17, 1996, which is incorporated herein by reference.

BACKGROUND OF THE INVENTION

This invention relates to a cylinder liner to be inserted into a cylinder bore of an engine block of an internal-combustion engine as well as a method of making the liner.

In internal-combustion engines having an engine block made of cast iron or an aluminum alloy, it is conventional to insert cylinder liners into respective cylinder bores of the engine block. The liner is a cylindrical tube, whose inner surface bounds the combustion chamber and, at the same time, serves as the running face for the piston rings. In view of the high wearing stresses that prevail during operation, wear-resistant cast iron, steel alloy or sintered material is used as the liner material. The running face of the liner has to be additionally machined which is an expensive procedure. In certain cases the running face is provided with a wear-resistant coating.

The manufacture of cylinder liners of the above-outlined type thus requires a significant technological outlay which involves substantial expenses. In addition, in the casting and sintering processes, the cylinder liner may be manufactured only within limited dimensional ranges. Particularly, for current personal motor vehicle engines having engine blocks made of aluminum alloys, thin-walled cylinder liners are required for optimizing the engine power. Such thin-walled liners are— if at all feasible — very circumstantial to manufacture with conventional methods.

SUMMARY OF THE INVENTION

It is an object of the invention to provide an improved cylinder liner for internal-combustion engines and an improved method for making possible a simple and economic manufacture of optimally thin-walled liners having a high degree of wear resistance.

This object and others to become apparent as the specification progresses, are accomplished by the invention, according to which, briefly stated, the method of making a cylinder liner for an internal-combustion engine includes the steps of applying a liner material to an outer cylindrical surface of a mandrel by thermal spraying for forming a coherent cylindrical sleeve on the mandrel, and removing the cylindrical sleeve from the mandrel. The cylindrical sleeve constitutes the cylinder liner.

Thus, according to the method of the invention, a mandrel is used which has an outer circumference which corresponds to the inner circumference of the cylinder liner to be made and the liner material is sprayed by means of known thermal spraying processes on the outer circumferential surface of the rotating mandrel in the desired thickness. Dependent on the construction, the liner positioned on the mandrel may be polished or shaped, if required. After removing the liner axially from the mandrel, the liner is machined on its radial end faces, if required.

The cylinder liner made according to the invention is stable and may be stored and handled without difficulties from the time of completion until its installation into the engine block. According to the method of the invention, cylinder liners with standard diameters for all current engine types may be made. The liner, in particular, may have a wall thickness from 1 mm and lengths in a range of 100–260 mm. It will be understood that these dimensions are only exemplary.

While any known thermal spraying process may be used, preferably flame spraying is employed. Any commercially available metal and/or metal-ceramic materials may be used as the sprayed material. It is also feasible to form the liner of a plurality of superimposed cylindrical layers. Thus, for example, the inner layer forming the running face of the liner may be a particularly wear and scorch resistant material such as molybdenum or a molybdenum alloy, while the outer layer (covering layer) may be an aluminum alloy. Between the two layers a binding layer may positioned, made, for example, of a spontaneously flowing (low melting point) cobalt alloy or nickel alloy. It is of particular advantage that the material may be chosen dependent upon the particular use, and by setting the spraying parameters, particularly an inner layer with optimal tribological properties may be obtained.

The outer circumferential surface of the mandrel is preferably hardened by a chrome treatment and, if required, may be provided with an anti-adherent spray to ensure that the finished cylinder liner may be readily drawn off the mandrel. A separate and expensive treatment of the running face of the liner by machining with material removal is in most cases not required since the running face has a shape which corresponds to the outer surface of the mandrel.

The cylinder liners according to the invention have been tested in engines and it was found that even for long-period runs the cylinder liners were optimally wear-resistant and the run was disturbance-free.

The invention thus provides a cylinder liner which may be manufactured in a simple and economical manner with the method of the invention. The liner according to the invention has optimal wear-resistant and tribological properties, it may be thin-walled and may be manufactured for practically all engine types.

DESCRIPTION OF THE PREFERRED EMBODIMENT

Figure 1:
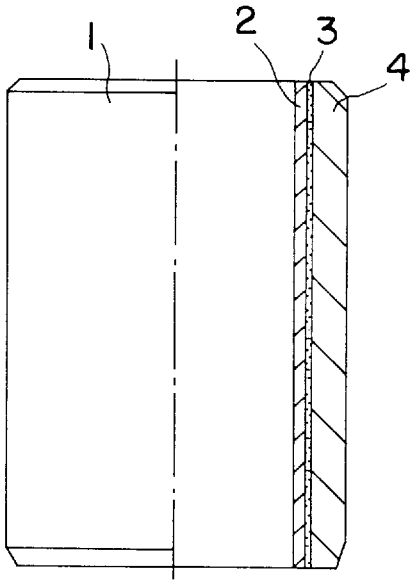
FIG. 1 is an axial sectional view of a cylinder liner according to a preferred embodiment of the invention.

Turning to FIG. 1, the cylinder liner 1 is formed of three superposed layers provided by thermal spraying. The inner layer 2 of the cylinder liner is a wear and scorch resistant molybdenum layer. The inner surface of the inner layer 2 forms the running face for the piston rings and defines the combustion chamber. To the outer circumferential surface of the molybdenum layer 2 a low-melting point cobalt alloy is applied as an intermediate binder layer 3 while the outer or cover layer 4 of the cylinder liner 1 consists of an aluminum alloy. The transition between the individual layers 2, 3 and 4 may be gradual.

Figure 2:
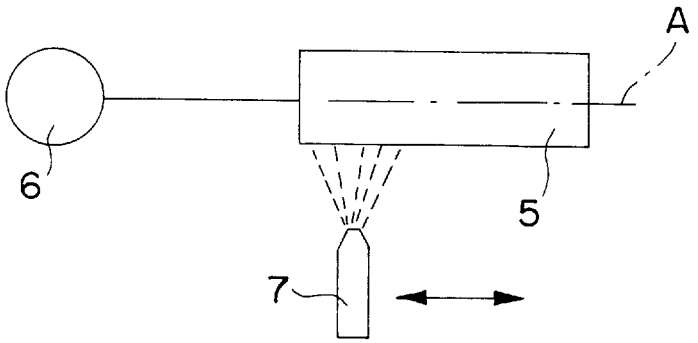
FIG. 2 is a schematic view showing a manufacturing step for making the cylinder liner.

FIG. 2 shows a mandrel 5 rotatable about its longitudinal axis A by a drive 6. A thermal spraying device 7 applies the above-described materials consecutively to the mandrel surface. After a coherent cylindrical sleeve has been formed on the mandrel 5, the sleeve is axially withdrawn therefrom.

It will be understood that the above description of the present invention is susceptible to various modifications, changes and adaptations, and the same are intended to be comprehended within the meaning and range of equivalents of the appended claims.

What is claimed is:

1. A method of making a cylinder liner for an internal-combustion engine, comprising the following steps:

(a) providing a mandrel having an outer cylindrical surface;

(b) applying a liner material to said outer cylindrical surface by thermal spraying for forming a coherent cylindrical sleeve on said mandrel; said step of applying a liner including the steps of (1) applying a wear-resistant layer directly to said cylindrical surface of said mandrel;

(2) applying a binder layer to said wear-resistant layer; and (3) applying a cover layer to said binder layer; and (c) removing said cylindrical sleeve from said mandrel; said cylindrical sleeve constituting said cylinder liner.

2. The method as defined in claim 1, further comprising the step of rotating said mandrel during step (b).

3. The method as defined in claim 1, wherein step (b) comprises the step of applying the liner material such that said cylinder liner has a wall thickness of at least 1 mm.

4. The method as defined in claim 1, further comprising the step of machining radial end faces of said cylinder liner.

5. The method as defined in claim 1, further comprising the step of polishing an outer circumferential surface of said cylinder liner.

6. The method as defined in claim 1, wherein said outer cylindrical surface is formed of a hard chromium layer; further comprising the step of sandblasting said chromium layer prior to performing step (b).

7. The method as defined in claim 1, wherein said outer cylindrical surface is formed of a hard chromium layer; further comprising the step of treating said chromium layer with an anti-adherence spray prior to performing step (b).

8. The method as defined in claim 1, wherein said wear-resistant layer is molybdenum; said binder layer is a low-melting point cobalt alloy and said cover layer is aluminum.

9. A cylinder liner for an internal-combustion engine obtained by a process comprising the following steps:

(a) providing a mandrel having an outer cylindrical surface;

(b) applying a liner material to said outer cylindrical surface by thermal spraying for forming a coherent cylindrical sleeve on said mandrel; said step of applying a liner including the steps of (1) applying a wear-resistant layer directly to said cylindrical surface of said mandrel;

(2) applying a binder layer to said wear-resistant layer; and (3) applying a cover layer to said binder layer; and (c) removing said cylindrical sleeve from said mandrel; said cylindrical sleeve constituting said cylinder liner.

10. The cylinder liner as defined in claim 9, wherein said wear-resistant layer is molybdenum, said binder layer is a low-melting point cobalt alloy and said cover layer is aluminum.

11. A method of making a cylinder liner for an internal-combustion engine, comprising the following steps:

(a) providing a mandrel having an outer cylindrical surface formed of a hard chromium layer;

(b) sandblasting said hard chromium layer;

(c) applying a liner material to said outer cylindrical surface by thermal spraying for forming a coherent cylindrical sleeve on said mandrel; and (d) removing said cylindrical sleeve from said mandrel; said cylindrical sleeve constituting said cylinder liner.

12. A method of making a cylinder liner for an internal-combustion engine, comprising the following steps:

(a) providing a mandrel having an outer cylindrical surface formed of a hard chromium layer;

(b) treating said hard chromium layer with an anti-adherence spray;

(c) applying a liner material to said outer cylindrical surface by thermal spraying for forming a coherent cylindrical sleeve on said mandrel; and (d) removing said cylindrical sleeve from said mandrel; said cylindrical sleeve constituting said cylinder liner.

* * * * *